US005419248A

United States Patent [19]

Brotzman

[11] Patent Number: 5,419,248

[45] Date of Patent: May 30, 1995

[54] ADJUSTABLE ALIGNMENT DEVICE FOR PRINTING PLATES

[75] Inventor: John M. Brotzman, Freeport, Me.

[73] Assignee: Heidelberg Druckmaschinen AG, Heidelberg, Germany

[21] Appl. No.: 208,357

[22] Filed: Mar. 9, 1994

[51] Int. Cl.[6] ..... B41F 27/00

[52] U.S. Cl. ..... 101/378; 101/415.1; 101/DIG. 36

[58] Field of Search ..... 101/116, 127.1, 128.1, 101/378, 415.1, 382.1, 383, DIG. 36

[56] References Cited

U.S. PATENT DOCUMENTS

| | | | |
|---|---|---|---|
| 3,659,525 | 5/1972 | Woessner et al. | 101/378 |
| 4,712,476 | 12/1987 | Jeschke | 101/378 |
| 4,748,911 | 6/1988 | Kobler | 101/378 |
| 4,831,931 | 5/1989 | Jeschke et al. | 101/415.1 |
| 4,862,800 | 9/1989 | Wieland et al. | 101/415.1 |
| 4,938,135 | 7/1990 | Wieland | 101/415.1 |
| 5,189,958 | 3/1993 | Tafel et al. | 101/415.1 |

*Primary Examiner*—Ren Yan

*Attorney, Agent, or Firm*—Tarolli, Sundheim & Covell

[57] ABSTRACT

The invention relates to a device for the aligning of printing plates (78) on a printing plate cylinder (10) for a rotary printing press. At least one bore (16) extends through the printing plate cylinder (10) in an axial direction. A movable actuating shaft (26) is disposed in the bore (16). Located in the shaft (26) are a plurality of ring-shaped tensioning and adjustment elements which are spaced apart from one another. The adjustment elements (36) have movable aligning elements/register pins (56) arranged thereon. The invention is characterized in that, for at least one adjustment element (36), an eccentric pin (21) extends between the adjustment element (15) and the register pin (19). The eccentric pin (21) is rotatable to move the register pin (19) along the adjustment element (15).

17 Claims, 3 Drawing Sheets

ADJUSTABLE ALIGNMENT DEVICE FOR PRINTING PLATES

BACKGROUND OF THE INVENTION

The present invention relates to a device for aligning printing plates on printing plate cylinders of rotary printing presses.

From U.S. Pat. No. 4,748,911 to Kobler there is known a device for the lateral register adjustment of a printing plate on a printing plate cylinder of a printing press. A turntable set wheel is arranged on the front side of the plate cylinder over which printing plate aligning stops are positionable on worm gear spindles. The pin of the set wheel can either have an inside threaded hole and an outside thread or only an outside thread.

In a first embodiment of the U.S. Pat. No. 4,748,911, two printing plate aligning stops can be laterally positioned. In a second embodiment of the U.S. Pat. No. 4,748,911, the printing plate aligning stops of two actuator sections connected with a coupling can be laterally positioned. Sensitive adjustment of individual printing plate alignment stops is difficult to accomplish. The positioning regions of the printing plate alignment stops are limited by the thread pitches and the thread section lengths.

SUMMARY OF THE INVENTION

It is an objective of the invention to optimize a device for the alignment of printing plates. It is a further objective of the present invention to compensate for web growth as a paper web travels through successive printing units.

According to the invention, an eccentric bolt, received on one hand by a ring-shaped adjustment element and on the other hand by a positionable aligning element, functions as an actuating means to relatively move the aligning element. An advantage in this solution is that the adjustment element, which is axially displaceable in an axial cylinder bore of a printing plate cylinder, can be fixed. When the adjustment element is fixed, precision adjustment of the aligning element is possible by movement of the eccentric bolt. The precision adjustment of the aligning element, relative to the adjustment element, can be made in such a way that the aligning element lies against the edge of a pre-punched receiving opening of a printing plate.

In one embodiment of the invention, the adjustment element is separated into a first wing and a second wing. The eccentric bolt has a head part, which engages a recess constructed in the first wing of the adjustment element. An eccentricity between a shaft of the eccentric bolt and the head part of the eccentric bolt determine an adjustment region through which the aligning element can be moved.

In one embodiment of the invention, a guidance mechanism guides relative movement between the aligning element and the adjustment element. The guidance mechanism includes parts which extend parallel to the rotational axis of the printing plate cylinder. In this manner, turning motion of the eccentric bolt and movement of the head part of the eccentric bolt connected therewith, can be converted into an axially directed displacement movement of the aligning element.

In one embodiment of the invention, a spreading screw is provided between the first wing and the second wing of the adjustment element. The first and second wings are provided with an elastic covering. When the spreading screw is rotated, the first and second wings of the adjustment element are pressed against the surfaces of a printing plate cylinder bore. This allows a factory-presetting of the adjustment element. The position of the adjustment element is variable if the corrections which can be achieved with precision adjustment are not sufficient.

BRIEF DESCRIPTION OF THE DRAWINGS

The invention will best be understood from the following description of an embodiment as illustrated in the accompanying drawings, in which.

DESCRIPTION OF PREFERRED EMBODIMENT

Figure 1:
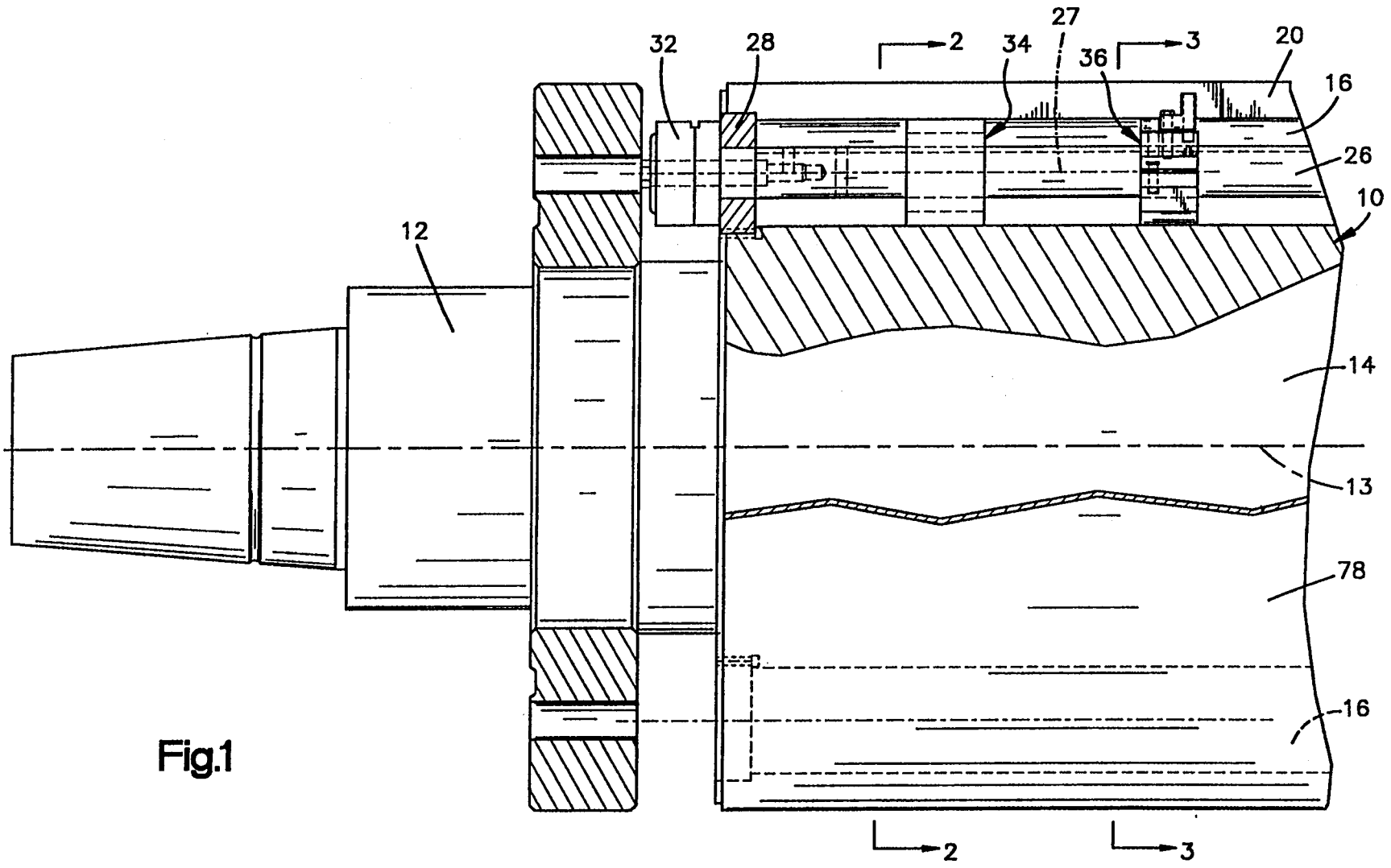
FIG. 1 is a partial sectional view of a printing plate cylinder with an actuating shaft in an axial cylinder bore.

A printing plate cylinder 10 (FIG. 1) is supported on 10 a cylinder journal 12 which is rotatably received in the side walls of a machine. The printing plate cylinder 10 is rotatable about an axis 13. The printing plate cylinder 10 has a cylindrical outer surface 14 and a plurality of axial cylinder bores 16. In a preferred embodiment, the printing plate cylinder 10 has two bores 16. Each bore 16 is located within the printing plate cylinder 10 and extends the axial length of the printing plate cylinder 10.

Figure 2:
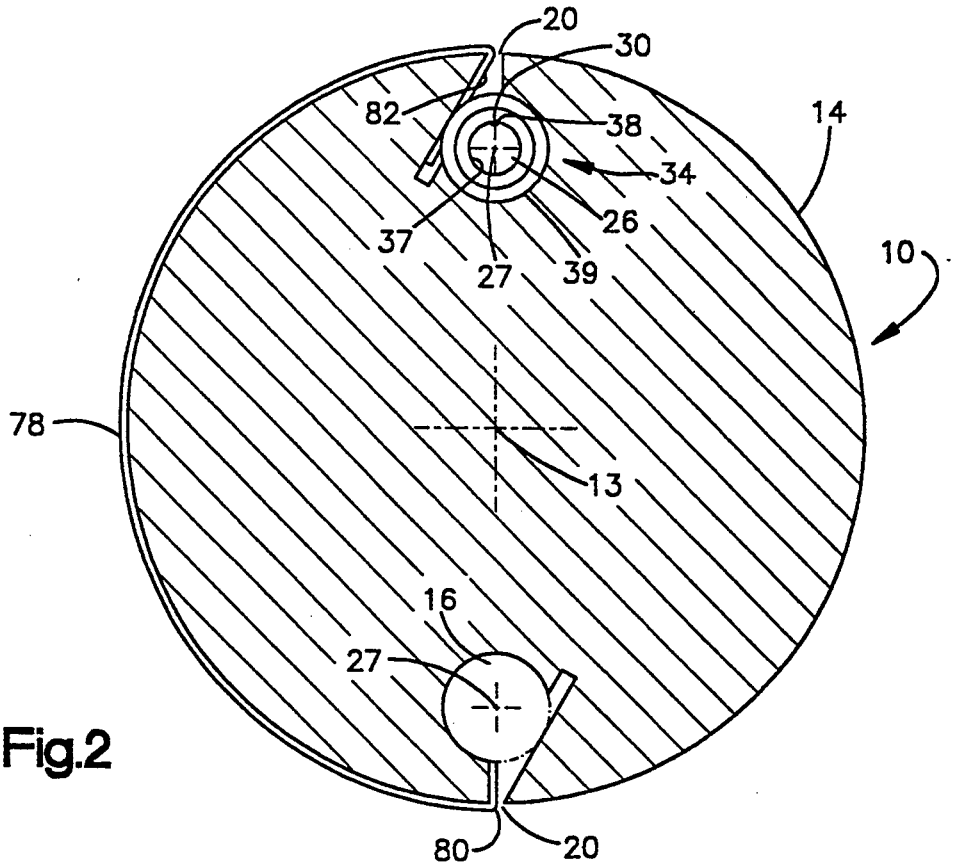
FIG. 2 is a cross-section view taken along the line 2—2 of FIG. 1.

In the preferred embodiment, the printing plate cylinder 10 has two slots 20 (FIG. 2). Each slot 20 extends the axial length of the printing plate cylinder 10. A first slot 20 extends through the outer surface 14 and intersects with a first one of the bores 16. A second slot 20 extends through the outer surface 14 and intersects with a second one of the bores 16.

An actuating shaft 26 (FIG. 1, only one shown) is located in each of the two bores 16 and is elongate along an axis 27 which is parallel to the axis 13 of the printing plate cylinder 10. Each actuating shaft 26 is rotatably supported by a bearing 28 (only one shown) provided on the end of the printing plate cylinder 10. Each actuating shaft 26 has a longitudinally extending groove 30. A locking mechanism 32, which is not described herein, is arranged on each actuating shaft 26 to hold the respective actuating shaft 26 in the bore 16.

Associated with each actuating shaft 26 are a plurality of ring-shaped tensioning elements 34 and a plurality of generally ring-shaped adjustment elements 36. The tensioning elements 34 and the adjustment elements 36 are alternately spaced along the respective actuating shaft 26. Each of the tensioning elements 34 has a center bore 37 (FIG. 2) through which the respective actuating shaft 26 extends. Each tensioning element 34 has a key 38 which engages with the groove 30 of the respective actuating shaft 26. Each tensioning element 34 can be moved along the respective actuating shaft 26 in an axial direction.

When a respective tensioning element 34 is moved along the respective actuating shaft 26 the key 38 slides along the groove 30. Each tensioning element 34 is rotated upon rotation of the respective actuating shaft 26 due to the interconnection of the key 38 and groove 30. The tensioning element 34 can be provided with an elastic covering 39 for increased resilience and friction.

Figure 5:
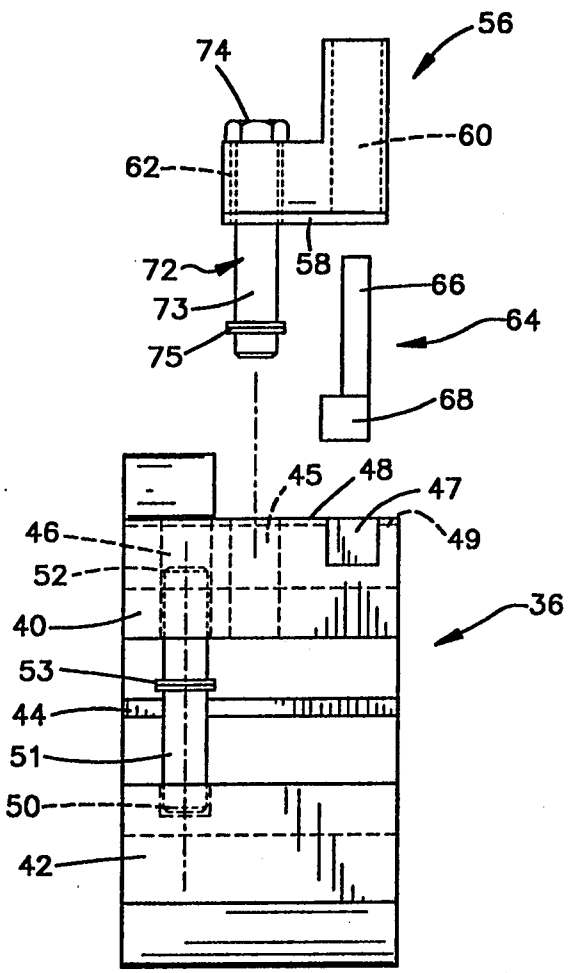
FIG. 5 is a view taken along line 5—5 in FIG. 4.

Each adjustment element 36 (FIG. 3) has a bore 41 through which the respective actuating shaft 26 extends. Each adjustment element 36 (FIGS. 4 and 5) is bifurcated to define first and second wings 40 and 42. A separating cut 43 and a slot 44 are located between the first wing 40 and the second wing 42. The cut 43 extends to intersect the bore 41 to define the first and second wings 40 and 42. Thus, the adjustment element 36 has a generally C-shape. The slot 44 extends radially from the bore 41 and increases the relative movability of the first and second wings 40 and 42.

Figure 4:
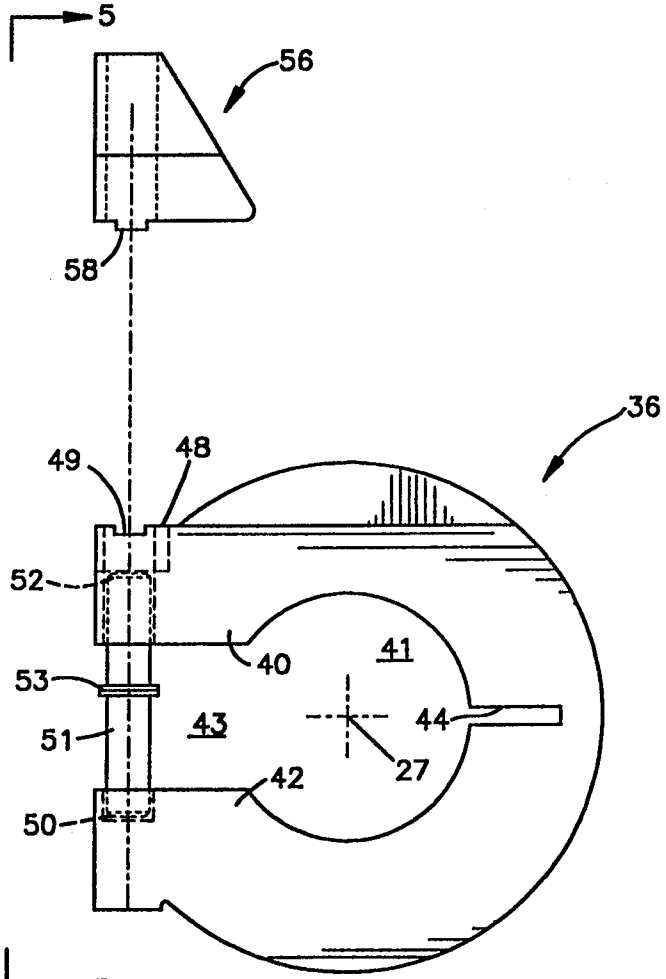
FIG. 4 is a view of an enlarged adjustment element.

The first wing 40 has a threaded bore 45 (FIG. 5), a threaded bore 46 and a circular recess 47. The first wing 40 also has a planar surface 48 and a groove 49 defined in the surface 48 which extends parallel to the axis 27 (FIG. 4). The second wing 42 has a blind hole 50.

A spreading screw 51 bridges the cut 43 between the first and second wings 40 and 42. The spreading screw 51 extends through the threaded bore 46 (FIG. 5) and is received in the blind hole 50. The spreading screw 51 has a head 52 for rotation of the spreading screw 51. When the spreading screw 51 is rotated, the first and second wings 40 and 42 relatively move. A clip 53 retains the spreading screw 51 on the first wing 40.

Figure 3:
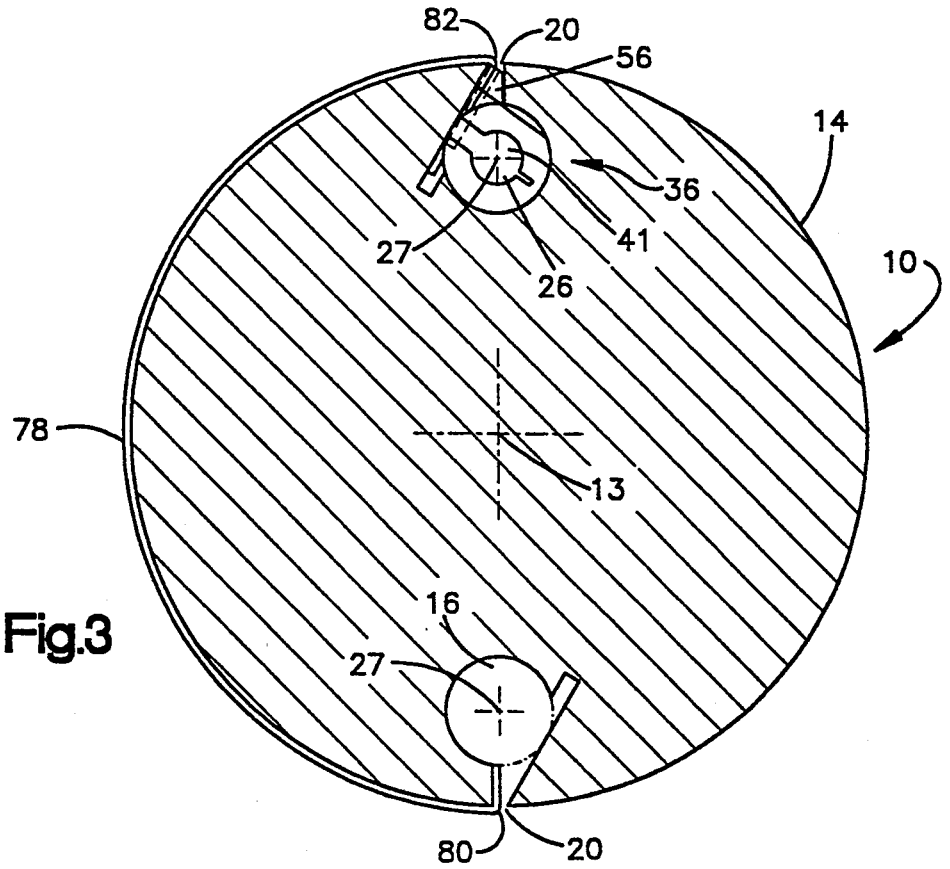
FIG. 3 is a cross-section view taken along the line 3—3 of FIG. 1.

Each adjustment element 36 (FIG. 1) can be moved along the respective actuating shaft 26 in an axial direction. When a respective adjustment element 36 is located at a desired position relative to the respective actuating shaft 26 and bore 16, the spreading screw 51 (FIGS. 4 and 5) can be rotated to wedge the first and second wings 40 and 42 against the surfaces which define the bore 16 (FIG. 3). The positioning of the adjustment element 36 with respect to the actuating shaft 26 and the printing plate cylinder 10 provides a course adjustment. Each adjusting element 36 may have an elastic covering (not shown) to increase resilience and friction.

A register pin 56 (FIGS. 4 and 5) is associated with each adjustment element 36. For each respective adjustment element 36 and register pin 56, the register pin 56 engages the first wing 40. The register pin 56 has a projection 58 which extends parallel to the axis 27 and which engages the groove 49 on the first wing 40. The register pin 56 is displaceable in the axial direction along the groove 49. The projection 58 on the register pin 56 can slide along the groove 49. Thus, precision adjustment can be performed individually on each register pin 56 relative to the actuating shaft 26 and the printing plate cylinder 10.

Each register pin 56 (FIG. 5) has a bore 60 and a bore 62. Received within the bore 60 of the register pin 56 and the circular recess 47 of the adjustment element 36 is an eccentric bolt 64. The eccentric bolt 64 has a circular shaft 66 located in the bore 60 and an eccentric head part 68 located in the circular recess 47. The head part 68 is rotated upon rotation of the circular shaft 66. Rotation of the eccentric head part 68 within the circular recess 47 causes the shaft 66 to move eccentrically and forces the register pin 56 to move relative to the adjustment element 36. However, the register pin 56 is constrained to axial movement by the interconnection of the projection 58 and groove 52.

A threaded screw 72 extends through the bore 62 of the register pin 56 and engages the threaded bore 45. The threaded screw 72 has a shaft 73 and a head 74. The bore 62 is oversized relative to the shaft 76 to permit movement of the register pin 56 relative to the threaded screw 72. The threaded screw 72 is rotated by way of the head 74 on its upper end. The screw 72 is rotatable to lock the register pin 56 relative to the adjustment element 36. A clip 75 retains the screw 72, and thus the register pin 56, with the adjustment element 36.

A plurality of printing plates 78 (FIGS. 2 and 3, only one shown) are arranged on the cylinder 10. Each printing plate 78 has a leading edge 80 and a trailing edge 82. In the preferred embodiment, there are two printing plates 78 arranged around the circumference of the printing plate cylinder 10 and four printing plates are positioned adjacent to each other along the axis 13 of the printing plate cylinder 10.

For each printing plate 78, the leading edge 80 is received and secured in one of the slots 20 of the printing plate cylinder 10. The printing plate 78 is guided (wound) over a portion of the outer surface 14 of the printing plate cylinder 10. The trailing edge 82 is located in a second one of the slots 20. The trailing edge 82 extends into the second slot 20 adjacent the tensioning elements 34 and the adjusting elements 36.

The tensioning elements 34 engage the trailing edge 82. To tighten the printing plate 78 about the printing plate cylinder 10, the actuating shaft 26 located in the second slot 20 is rotated (counterclockwise as shown in FIG. 2) to rotate the tensioning elements 34. Rotation of the tension elements 34 draws the trailing edge 82 further into the second slot 20.

Each printing plate 78 has registration engagement portions, i.e. openings (not shown), into which the respective register pins 56 extends. Thus, the register pins 56 are aligning elements for the respective printing plate 78. The printing plate 78 is fixed in its position by fixing the adjustment elements 36 and the register pins 56 into respective positions so that the surfaces of the register pin 56 engage against the edges of the opening in the printing plate 78. Fixing of each adjustment element 36 is done by turning the spreading screw 51, which spread the first and second wings 40 and 42 and wedge the adjustment element 36 in the respective bore 16. Fixing of the register pin 56 takes place by rotating the threaded screw 72.

Due to the fact that a web to be printed receives a considerable amount of moisture and ink while passing the successive units, the web tends to expand, especially in the direction along the axis. This fan-out phenomenon can be compensated for by moving the register pins 56 accordingly. For this purpose, each eccentric bolt 64 is laterally adjustable within a range along the respective register pin 56. Adjustment is done when the printing plate cylinder 10 is stationary and accomplished by loosening the threaded screw 72 and rotating the eccentric bolt 64.

The lateral adjustment to compensate for web growth depends upon the number of printing units a web has to pass. It is obvious that the amount of lateral adjustment in the last printing unit is greater because the web has received a greater amount of moisture and ink and, therefore, has expanded considerably in the lateral direction. Whereas the amount of lateral adjustment due to web expansion in the earlier printing units will be considerably less. The register pins 56 can be moved laterally to the left or right, depending upon the direction in which the precision adjustment is necessary, e.g., either the right side edge or the left side edge of the printing plate 78 needs to be moved. All of the printing plates 78 which are received on the printing plate cylinder 10 can be handled in this way. The correct position of the register pins 56 can be marked at the edge of the respective slots 20 for certain formats which need to be printed often. Thus, a rough setting of the adjustment element 36 can be effected by aligning with the marks. Precision adjustment takes place through the axial movement of the register pins 56, so that quick adjustment can be made.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for aligning a printing plate on a rotary printing press cylinder which has an axial channel, said apparatus comprising:

an adjustment member for lockingly engaging a surface of the cylinder at the axial channel to prevent relative movement between said adjustment member and the cylinder;

a register member for engaging a surface of the printing plate, said register member being movable relative to said adjustment member;

fastener means for connecting said register member to said adjustment member and for locking said register member in a position relative to said adjustment member; and positioning means for moving said register means relative to said adjustment member, said positioning means including a bolt extending from said register member to said adjustment member, said bolt having an eccentric surface;

said adjustment member including a C-shaped element which has two wings, and a means for spreading said wings apart for wedging said wings into engagement with the surface of the cylinder at the axial channel.

2. An apparatus as set forth in claim 1, wherein said fastener means connects said register member to said adjustment member at one of said wings.

3. An apparatus for aligning a printing plate on a rotary printing press cylinder which has an axial channel, said apparatus comprising:

an adjustment member for lockingly engaging a surface of the cylinder at the axial channel to prevent relative movement between said adjustment member and the cylinder;

a register member for engaging a surface of the printing plate, said register member being movable relative to said adjustment member;

fastener means for connecting said register member to said adjustment member and for locking said register member in a position relative to said adjustment member; and positioning means for moving said register means relative to said adjustment member, said positioning means including a bolt extending from said register member to said adjustment member, said bolt having an eccentric surface;

said adjustment member having a threaded hole, said register member having a bore, said fastener means including a threaded element positioned to extend through said bore on the register element and into said threaded hole.

4. An apparatus for positioning a printing plate on a printing plate cylinder of a rotary printing press, the cylinder having at least one bore extending in the axial direction of the cylinder, said apparatus comprising:

a movable actuating shaft disposed in the bore of the cylinder;

a plurality of ring-shaped tensioning elements and adjustment elements spaced along the actuating shaft, said actuating shaft extending through each of said tensioning elements and said adjustment elements, movement of said actuating shaft moves said tensioning elements to tighten the printing plate on the cylinder;

a movable aligning element arranged on one of said adjustment elements for aligning the printing plate on the cylinder; and an eccentric means engaging said one adjustment element and said aligning element and being rotatable relative to said one adjustment element and said aligning element for linearly moving said aligning element relative to said one adjustment element.

5. An apparatus as set forth in claim 4, wherein the printing plate has an opening, said aligning element includes a register pin for extending into the opening in the printing plate.

6. An apparatus as set forth in claim 5, wherein said register pin has a bore and said one adjustment element has a recess, said eccentric means includes a shaft part for location in said bore in said register pin and an eccentric head part for location in said recess in said one adjustment element.

7. An apparatus as set forth in claim 4, wherein said one adjustment element is bifurcated and has first and second wings.

8. An apparatus as set forth in claim 7, wherein said first wing has a recess, said eccentric means includes a head part for location in said recess in said first wing.

9. An apparatus as set forth in claim 7, including a spreading screw received between said first and second wings for spreading said first and second wings and engaging said first and second wings against the cylinder.

10. An apparatus as set forth in claim 4, including guide means for guiding movement of said aligning element relative to said one adjustment element in a direction parallel to the axial direction.

11. An apparatus as set forth in claim 10, wherein said one adjustment element is bifurcated and has first and second wings, said first wing has a recess and said aligning element has a bore, said eccentric means includes a head part for a location in said recess in said first wing and a shaft part for location in said bore in said aligning element, rotation of said eccentric means moves said aligning element relative to said one adjustment element in a direction guided by said guide means.

12. An apparatus as set forth in claim 10, wherein the cylinder has a receiving slot, the printing plate is partially received in the receiving slot in the cylinder.

13. An apparatus for aligning a printing plate, which has a registration engagement portion, on a rotary printing press cylinder, which has surface segments defining an axial channel, said apparatus comprising:

an adjustment member movable along the axial channel to a selected one of a plurality of positions, said adjustment member in its selected position being adjacent to the registration engagement portion of the printing plate, said adjustment member having two relatively movable portions for wedging against the surface segments of the cylinder defining the axial channel to hold said adjustment member in its selected position and to prevent relative movement between said adjustment member and the cylinder;

a register member for engaging the registration engagement portion of the printing plate when the printing plate is in an aligned position on the cylinder, said register member being movable relative to said adjustment member along the axial channel to a selected one of a plurality of positions, said register member in its selected position precisely mating with the registration engagement portion of the printing plate;

fastener means for connecting said register member to said adjustment member and for locking said register member in its selected position relative to said adjustment member; and positioning means for moving said register member relative to said adjustment member, said positioning means including a bolt extending from said register member to said adjustment member, said bolt having an eccentric surface.

14. An apparatus as set forth in claim 13, wherein said adjustment member has a recess, said register member has a bore, said bolt has a shaft and a head, said eccentric surface is located on said head, said shaft is positioned in said bore, said head is positioned in said recess, said shaft is rotatable relative to said register member to cam said eccentric surface on said head relative to said adjustment member.

15. An apparatus as set forth in claim 14, wherein said register member is movable in a direction parallel to an axis of the cylinder when said adjustment member is lockingly engaged with the cylinder and said shaft of said bolt is rotated relative to said register member.

16. An apparatus as set forth in claim 13, wherein one of said adjustment member and said register member has a groove and another of said adjustment member and said register member has a projection, said projection is positioned in said groove, said projection is movable along said groove upon movement of said register member relative to the adjustment member.

17. An apparatus as set forth in claim 13, including guide means for guiding movement of said register member relative to said adjustment member in a direction parallel to the axis of rotation of the cylinder.

* * * * *